US006158925A

United States Patent [19]

Schleining et al.

[11] Patent Number: 6,158,925

[45] Date of Patent: Dec. 12, 2000

[54] APPARATUS FOR INSTALLING PIPELINE FILL

[75] Inventors: Gregory L. Schleining, Phoenix, Ariz.; Jerry B. Askin, Belgrade; Joseph P. Nelson, Bozeman, both of Mont.

[73] Assignee: Barnard Construction Company, Inc., Bozeman, Mont.

[21] Appl. No.: 09/275,353

[22] Filed: Mar. 23, 1999

Related U.S. Application Data

[60] Provisional application No. 60/079,347, Mar. 24, 1998.

[51] Int. Cl.[7] ..... F16L 1/028

[52] U.S. Cl. ..... 405/179; 37/142.5; 405/154; 405/180

[58] Field of Search ..... 405/178, 180, 405/154, 157, 174; 37/142.5, 395

[56] References Cited

U.S. PATENT DOCUMENTS

| | | | |
|---|---|---|---|
| 3,874,182 | 4/1975 | Potter et al. | 405/179 |
| 4,301,910 | 11/1981 | Price | 405/179 X |
| 4,633,602 | 1/1987 | Layh et al. | 37/195 |
| 5,913,638 | 6/1999 | Landale | 405/179 |
| 5,921,707 | 7/1999 | Owen | 404/75 |
| 5,938,373 | 8/1999 | Scudder | 405/179 |

FOREIGN PATENT DOCUMENTS

| | | | |
|---|---|---|---|
| 000626483 A2 | 11/1994 | European Pat. Off. | 37/142.5 |
| 3720556 | 1/1988 | Germany | 405/179 |

*Primary Examiner*—Dennis L. Taylor
*Attorney, Agent, or Firm*—Todd N. Hathaway

[57] ABSTRACT

An apparatus for depositing fill material over a pipeline. A wide-track carriage is provided for straddling the pipeline trench, and this includes a shaker screen mechanism for screening aggregate fill material, such as excavated native spoils. The screened fill material is fed into the trench via a pivoting conveyor which is controlled by means of a pivotable and extensible boom. A mix auger is also provided for mixing water and cement with the fill material to form a cementitious Controlled Low Strength Material fill in those installations where this is needed.

26 Claims, 3 Drawing Sheets

APPARATUS FOR INSTALLING PIPELINE FILL

This Appln. Claims Benefit of 60/079,347 Mar. 24, 1998.

BACKGROUND a. Field of the Invention

The present invention relates generally to installation of underground pipelines and similar conduits, and, more particularly, to an apparatus for installing fill material around a pipeline after this has been placed in an excavated trench.

b. Related Art

Underground pipelines are used for many purposes, including oil and natural gas lines, water lines, sewer lines and electrical power conduits, for example. In most instances, such pipelines are installed by excavating a trench in the earth, laying the pipe in the trench, and then placing protective fill material around and over the pipe.

The protective fill material is normally one of two types. For oil and gas lines and similar types of high-strength pipe, the fill material is ordinarily a soil or gravel material which is screened for size, but which does not necessarily include a cement or other binder component. The padding in such installations serves mostly to protect the pipe from coming into contact with large/sharp rocks in the subterranean formation or in overlying layers of backfill. The padding also protects the pipe from vertical loads, such as the weight of the overlying fill or that of a vehicle crossing over the trench, by directing these loads outwardly into the earth along the sides of the trench. Still further, the padding serves to protect the pipe against excessive pressures in the event of a shifting or collapse of the earth along the trench, as due to an earthquake for example, and also protects the cathodic protection coating on the pipeline material itself.

In order to serve these functions, the fill material must be screened to exclude pieces of rock greater than a predetermined size, and the material must then be distributed carefully in a predetermined profile over and around the pipe. Also, depending on the specifications for the installation, different (e.g., coarser or finer) grades of material may need to be installed in layers to form the fill, and cement and/or fly ash may also be included in one or more of the layers to provide a stronger, more coherent padding. Furthermore, in some installations it is necessary to add a certain amount of water to the padding material so as to form a slurry which is able to flow in and fill completely around and underneath the pipeline (e.g., see FIG. 3).

To obtain the fill material, excavated earth (often, the native spoils excavated from the trench itself) is trucked or otherwise transported to a screening plant. After screening, the material is transported back to the trench, where it is dumped onto the pipe using a truck or loader. Not only is such a process time consuming and inefficient, but simply dumping the material onto the pipe in this manner makes it very difficult to provide the fill with the proper contour.

Certain machines have been developed for the specific purpose of screening and installing pipeline padding, but these have generally been unsatisfactory in one or more respects. To illustrate these problems, a typical prior art pipeline padder 10 is shown in FIG. 1; machines of this type are available from several sources, including Ozzie's Pipeline Padder Co., 1545 West Watkins, Phoenix, Ariz.

As can be seen in FIG. 1, prior art padders typically include some form of tracked carriage 12 which propels the vehicle alongside the trench 14 (in some instances there is a separate bulldozer or other tracked vehicle which carries or propels the assembly), in the direction indicated by arrow 16. As the machine moves along, an on-board conveyor 18 picks up excavated backfill lying alongside the trench and discharges this on top of a vibrating screen shaker 22. Fines in the backfill pass through the screen shaker, while larger rocks and debris roll off the screen and are discarded as indicated at 24.

The screened material falls onto a transverse belt 26 which transports the material sideways towards the trench at a comparatively high speed. A deflector plate 28 mounted at the end of the conveyor assembly intercepts the material and redirects this downwardly on top of the pipeline 30 so as to form the padding 32.

While machines of this type are in widespread use, their efficiency is limited by a number of problems which are inherent in the basic configuration. One of the most serious drawbacks is the inability of the operator to effectively control placement of the material in trench. As can be seen, the operator 34 is located well off to the side of the trench, in a position where he is viewing the pipe at an angle and where his sight is partially obstructed by the upper edge of the trench. As a result, it is difficult or impossible for the operator to see whether the fill is being placed correctly at any given point. Moreover, the operator has only limited control over the position of the conveyor assembly, and the transverse alignment of the conveyor (shooting crosswise onto the trench) makes it very difficult to direct the flow of material with any degree of accuracy.

These deficiencies have become more acute with the development of more sophisticated pipeline padding or bedding techniques, some of which require the installation of several layers of fill material, each of which has its own specified depth and profile. For example, FIG. 2 shows an installation in which the first layer of fill 36 is formed of a comparatively fine material which surrounds the pipe and has a domed profile 38 along its upper surface, while the subsequent layers 40 and 42 vary in thickness and coarseness of the material. It will be appreciated that this form of padding requires precise, controllable placement of the different grades of fill material, which has been very difficult to accomplish using existing types of machines.

Furthermore, certain installations call for mixing water with the fill material, so as to make it more flowable, or for mixing in Portland cement or other cementitious material to form a stronger, more coherent fill. In particular, most water lines require the use of a cementitious fill material, commonly referred to as Controlled Low Strength Material (CLSM). Water lines are typically much thinner walled and weaker than gas or oil lines, and the shape and strength of the fill material, forms a significant part of the design strength of the pipe.

Existing types of pipeline padding machines, such as that described above, have no provision for adding and mixing water and cement with the fill so as to form a CLSM material. As a result, CLSM fill has typically been made at a local concrete ready-mix plant and then trucked to the installation site, where it is placed using the discharge chute of the mixer truck. This practice is extremely inefficient in several respects. Firstly, if the native spoils which have been excavated from the trench are to be used in the CLSM fill, these must be trucked from the excavation site to the to the ready-mix plant; otherwise, the excavated material must be disposed of and new aggregate material purchased to form the CLSM.

Furthermore, the CLSM begins to set immediately after mixing and must be deposited in the trench within a comparatively short time. Not infrequently, however, the bedding operation is interrupted for one reason or another (e.g., to make a repair or correction), or the operation has advanced to a section of the pipeline where the fill material is not needed. When this happens, the CLSM material from the ready-mix plant must be disposed of in short order, before it sets up inside the mixer truck. Not only does this cause the material to be wasted, but it is also necessary to find (or excavate) a hole or other cavity into which the material can be dumped.

Accordingly, there exists a need for a pipeline padding/bedding machine which enables the operator to accurately place the fill material in the desired positions and contour around and over a pipeline. Furthermore, there exists a need for such an apparatus in which water can be added to the fill material in an efficient, continuous manner, when this is needed in order to form a slurry or flowable padding which will flow completely under and around a pipeline and/or pipeline appurtenance. Still further, there exists a need for such an apparatus in which Portland cement or other cementitious materials can be incorporated in the fill material in an efficient, manner when these are needed, and on a continuous or interrupted basis as necessary.

SUMMARY OF THE INVENTION

The present invention has solved the problems cited above, and is an apparatus for preparing and installing pipeline padding or bedding material in a controllable manner.

The apparatus includes a tracked platform which straddles the trench, with the operator cab being mounted near the midpoint of the platform to provide a clear view looking down into the trench. A screen assembly sorts raw backfill material to exclude excessively large pieces, and the screened material is fed to a conveyor belt which extends at a forward angle towards the trench. The fill material is directed downwardly into the trench though a hopper assembly at the discharge end of the belt.

When adding water and/or cementitious material to the padding material, a horizontal auger is mounted to the lower end of the hopper assembly. Preferably, the lower portion of the hopper assembly is rotatable about a vertical axis, with the auger being mounted to this lower portion and extends forwardly towards the trench. The forward end of the auger is supported from an extensible crane assembly, so that by rotating and/or extending/retracting the crane assembly, the operator is able to precisely control the discharge point of the horizontal auger, thereby achieving precise placement of the padding, bedding or slurry material.

The apparatus may also include means for mixing water with the padding material so as to form a flowable slurry. This may comprise a water supply line which discharges into the rearward end of the horizontal auger, so that the padding material and water are thoroughly mixed before being discharged into the trench.

The apparatus may also include means for mixing a cementitious slurry with the padding material. This may comprise a cement silo which discharges cement dust into the intake end of the swivel hopper, along with water from the supply line. The cement dust and water combine with the screened backfill material in the hopper and enter the intake end of the horizontal auger, in which they are mixed so as to form a cementitious slurry prior to being discharged into the trench.

DETAILED DESCRIPTION

Figure 3:
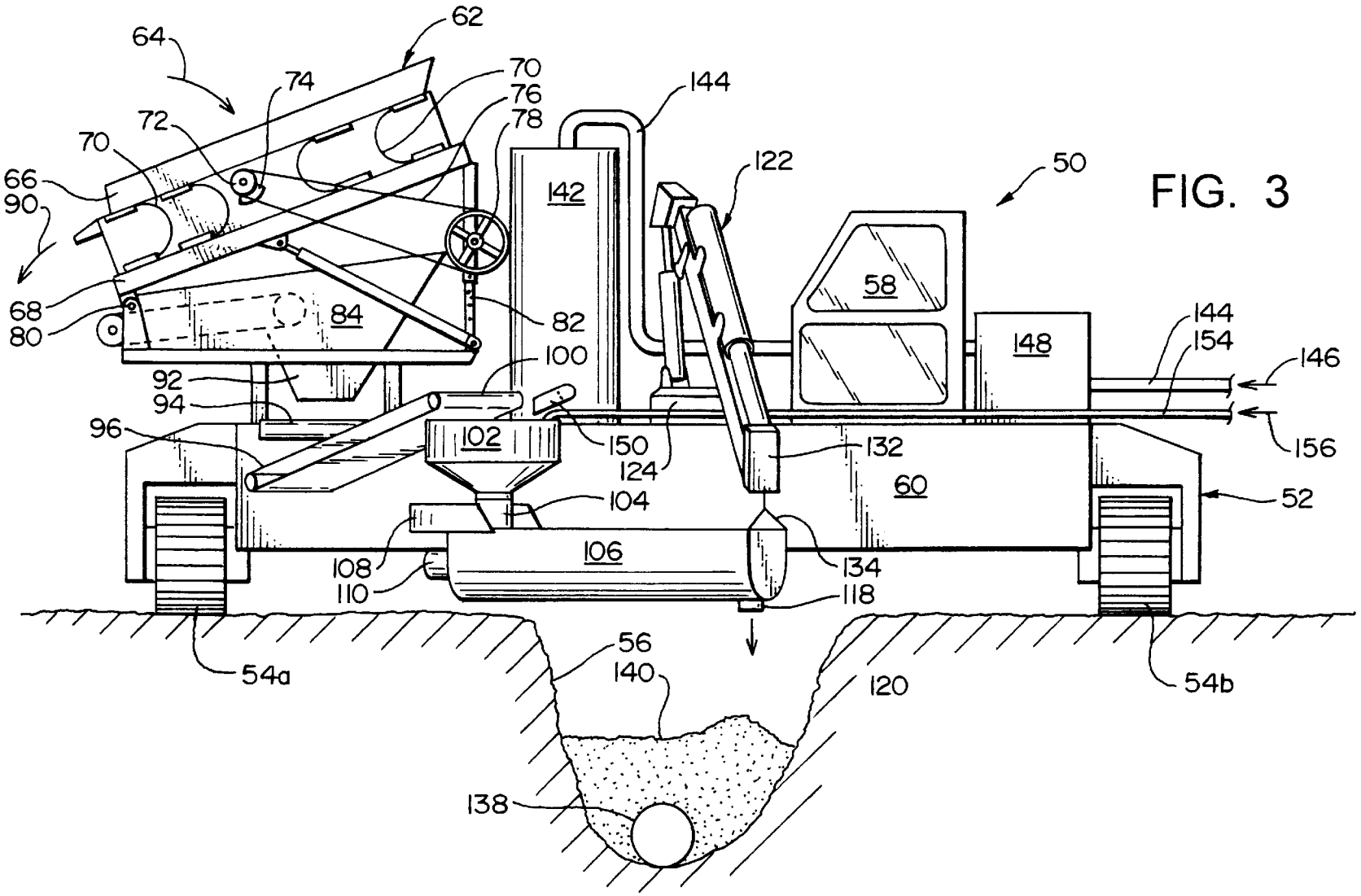
FIG. 3 is a front elevational view of a pipeline padding and bedding machine in accordance with the present invention, showing this straddling a trench so as to install fill material therein.

FIG. 3 shows a pipeline padding or bedding installation apparatus 50 in accordance with the present invention. As can be seen, this includes a wide-track crawler carriage 52 having a first and second propulsion tracks 54*a,* 54*b* which are spaced apart by a distance sufficient to enable the carriage to straddle a pipeline trench 56 of ordinary width. For example, a track spacing of approximately 22½ feet is eminently suitable for most conventional applications (although the width can be adjusted by adding sections to the carriage, to approximately 38 feet wide, for example).

Figure 4:
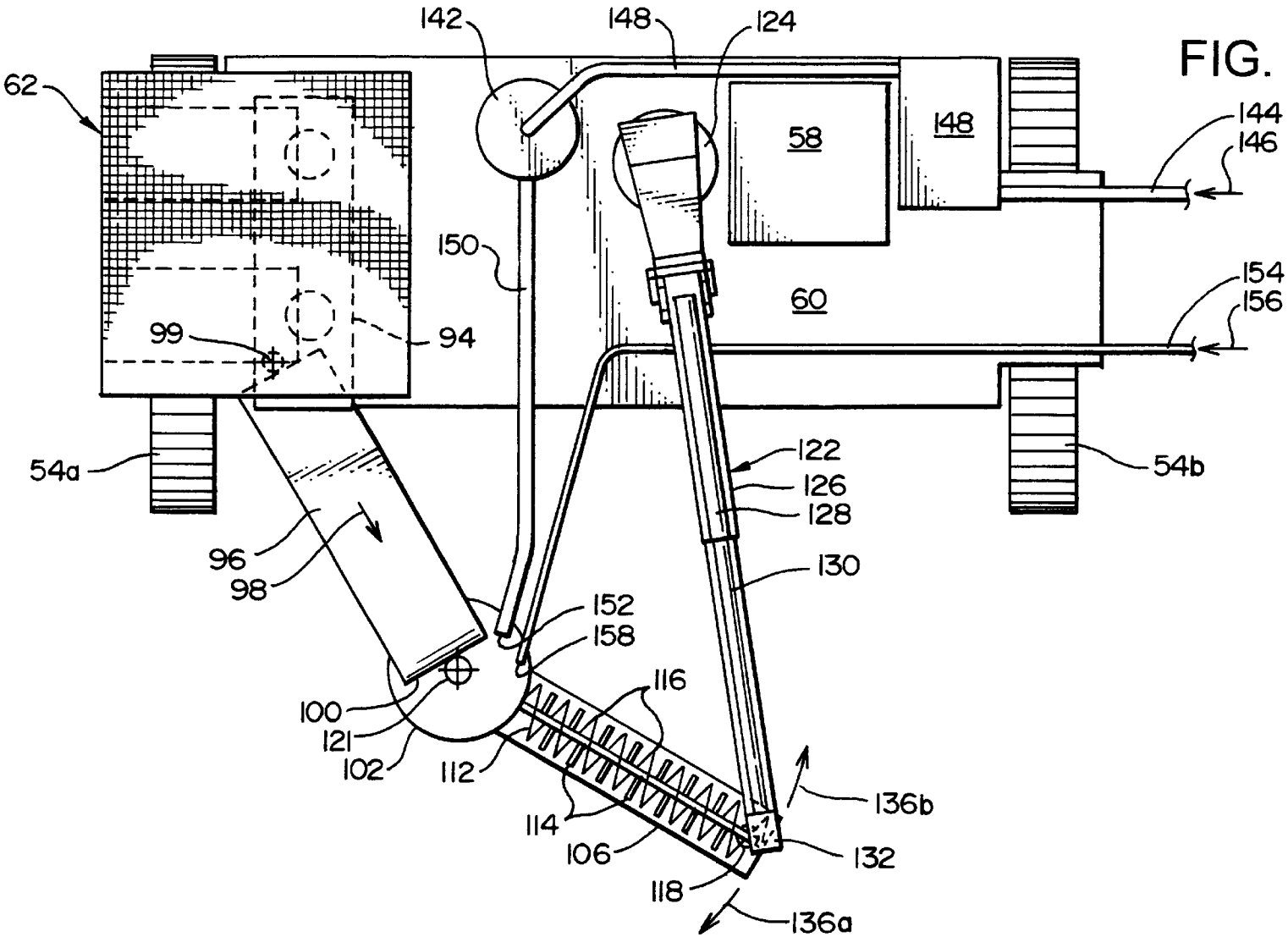
FIG. 4 is a plan view of the apparatus of FIG. 3, showing the configuration of the pivotable discharge assembly, and also the mechanism by which cement is selectively added and mixed with the fill material before this is discharged into the trench.

An example of a tracked undercarriage suitable for use in the embodiment of the invention which is illustrated in FIGS. 3–4 is available from Henry Machine Company, Inc., Pierce, Colo. An on-board diesel engine (not shown) serves as the prime mover, and the tracks are independently controllable by means of a conventional pedal mechanism. The diesel engine also drives the hydraulic pumps (not shown) which provide hydraulic pressure to operate the other on-board systems. Suitable hydraulic coolers and controls are provided for controlling the operation of the various systems, such controls being well known to those skilled in the art of design and manufacture of hydraulic systems.

An operator station 58 (in the form of an enclosed cab in the embodiment which is illustrated) is mounted proximate the midpoint of the main platform 60 of the tracked carriage. Because the carriage spans the trench, this location provides the operator with a clear, unobstructed view looking down on the trench and pipeline, so that the operator is able to observe exactly where the fill material needs to be placed. The operator station also houses the controls (not shown) for operating the principal subsystems of the apparatus.

A vibrating screen mechanism 62 is mounted on one side of the platform 60 (to the left in FIG. 3). In this position, the screen mechanism is readily accessible from the side, so that this can receive backfill material which is dumped into the top of the vibrator in the direction indicated by arrow 64, using a front-end loader, for example.

Although a single-deck vibrating screen mechanism may be used in the assembly, FIG. 3 shows a two-deck mechanism having upper and lower screens 66 and 68. The two-deck mechanism has the advantage of providing a large screen area without occupying an excessive area on the platform 60. As a result, the upper end of the two-deck mechanism provides a large "target" for the loader operator to hit with the material, while the lower end funnels down to a comparatively small area on the carriage itself.

As can be seen, the upper and lower screens 66, 68 of the two-deck mechanism extend parallel to one another, at an outwardly sloped angle relative to the machine 50. The upper and lower screens are joined by a series of "C"-shaped springs 70, and a rotating shaft 72 is mounted to the upper screen 66. The shaft carries a plurality of bob weights 74, and is driven via belt 76 from a hydraulically powered pulley 78. Operation of shaft 72 thus causes the upper and lower screens to vibrate on springs 70. Moreover, a pivot connection 80 at one end of the screens and an adjustable leg 82 at the other allow the angle of the screens to be adjusted as needed, depending on the nature of the excavated material and other factors.

Materials below a predetermined size pass through the vibrating screen mechanism 62 (see also FIG. 4) and fall into the underlying hopper section 84, while larger pieces roll down the screens and are discarded in the direction indicated by arrow 90.

Because (unlike the prior-art padder described above) the apparatus 70 of the present invention is fed by a loader, the padding/bedding operation is not dependent on maintaining forward motion of the machine. In other words, the machine 70 can remain stationary if necessary, while fill material is brought to it by the loader. Moreover, the loader can avoid larger boulders and other objects in the excavated material which might otherwise interfere with the screen mechanism, and if necessary can bring additional material to the padding/bedding machine from areas away from trench itself.

The comparatively fine fill material passes through to the hopper section 84 is discharged through chute 92 onto the rearward end of a longitudinal conveyor 94. As can be seen in FIG. 4, the forward end of the longitudinal conveyor 94 is positioned just above the rearward end of a second, angled conveyor 96, so that fill material from the first conveyor is discharged onto the second conveyor and travels in a forward and inward direction, as indicated by arrow 98. To aid in controllable placement of the fill, the rearward end of the longitudinal conveyor is mounted for pivoting movement in the horizontal plane, as indicated at 99 in FIG. 3; moreover, the angle of the second conveyor 96 is somewhat parallel to the trench, rather than crosswise to the trench as in the prior art machines described above.

As can be seen in FIGS. 3 and 4, the second conveyor 96 is inclined upwardly and has its discharge end 100 positioned in vertical alignment above the open top of a swivel hopper 102. The comparatively large diameter of the upper end of the hopper allows a certain amount of shifting movement to take place between the hopper and its respective feed lines without the discharge ends of the feed lines moving out of register with the hopper. The lower chute portion 104 of hopper 102 is pivotally mounted to the upper portion so that the latter is able to rotate about a vertical axis.

The lower end of the chute portion 104 is mounted to and discharges into the rearward end of an auger trough 106, a shield panel 108 being mounted around the rearward end of the trough to prevent material from splashing over the edges in this area. A hydraulic motor 110 at the rearward end of the trough drives a horizontal mix auger 112 (see FIG. 4) which extends axially the full length of the trough. The mix auger is somewhat similar to an Archimedes' screw, and is driven by the motor so that the fill material is pushed in a generally longitudinal direction through the trough. The auger also preferably includes a plurality of short paddle members 114 which are mounted along the auger shaft intermediate the flights 116; the paddle members serve to break up clumps in the fill material, thereby ensuring more even mixing and also reducing wear on the auger screw.

Suitable sizes for the mix auger in the embodiment which is illustrated in FIGS. 3–4 may be approximately 12–16" in diameter and approximately 12' in length. After mixing in the auger trough, the fill material is discharged at the forward end thereof through a bottom opening 118, as indicated by arrow 120 in FIG. 3.

The connection to the pivoting hopper at its rearward end provides the auger trough with a pivot connection 121 which enables the trough to swing back and forth in a horizontal plane. The forward end of the auger trough, in turn, is supported from a knuckle-boom crane 122 which is mounted on a turntable 124 (see FIG. 4) for rotation about the vertical axis, and which includes an articulated arm 126 having extensible hydraulic cylinders 128, 130. Cranes of this general type are available from various manufacturers/suppliers of pipe laying equipment, including the Henry Machine Company noted above. It should also be noted that in instances when water and/or cement are not being added to the fill material, so that there is no need for mixing the components in the horizontal auger, the auger can simply be removed and the crane can be attached to the outer end of the forwardly-extending conveyor 96 for directing the discharge of material into the trench therefrom.

The auger trough is supported from the end 132 of the crane arm by a bridle 134 which accommodates changes in angular orientation between the two members. Moreover, as was noted above, the auger and feed conveyor are mounted to the chassis by pivot connections 99 and 121 which permit pivoting movement in the horizontal plane. Thus, by turning the crane back and forth and/or increasing/decreasing the effective length of the articulated arm, the operator is able to swing the discharge end of the auger trough through a horizontal arc to precisely controlled positions, as indicated by arrows 136*a* and 136*b* in FIG. 4.

This precise control, in combination with the direct, unobstructed line of sight looking down into the trench from the operator's station 58, enables the operator to accurately place the padding fill where this is needed to uniformly cover the pipeline 138 and develop the proper contour, as that indicated by 140 in FIG. 3.

Figure 1:
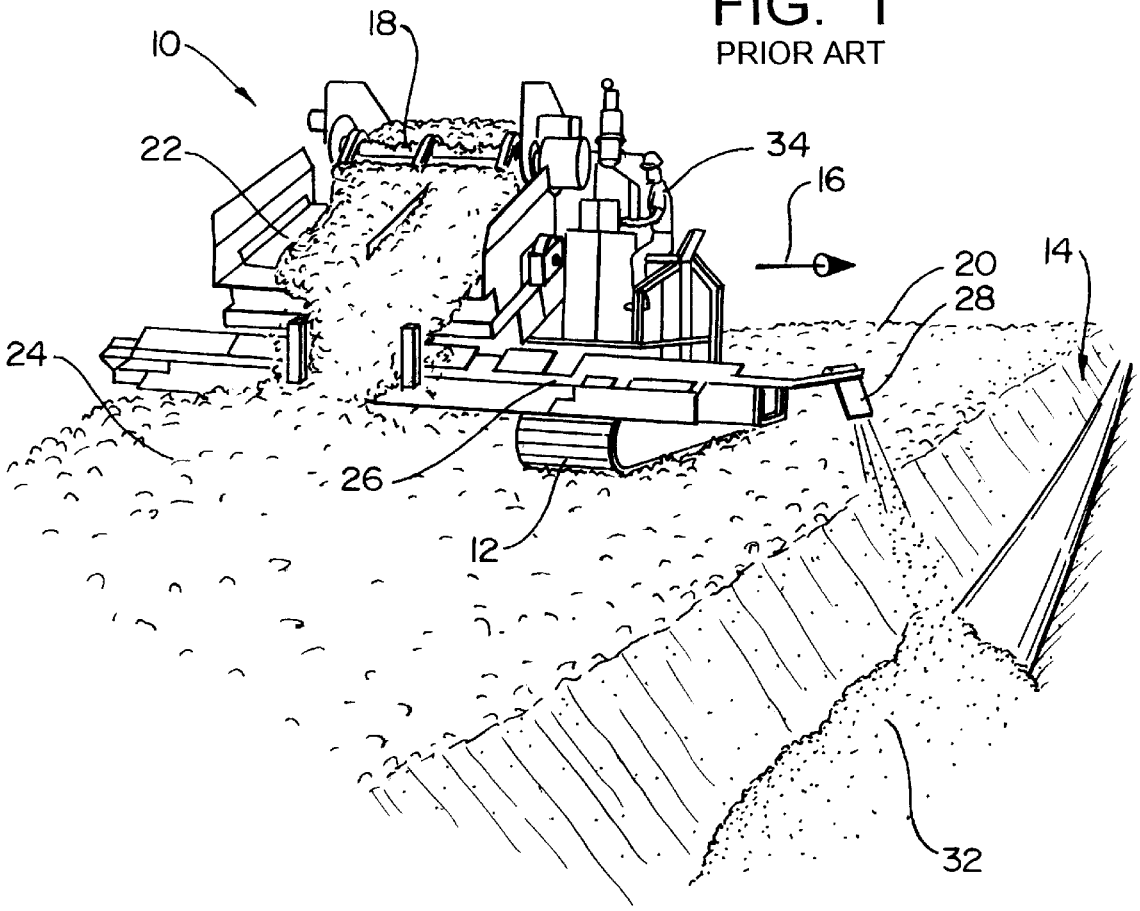
FIG. 1 PRIOR ART
FIG. 1 is a perspective, environmental view of a prior art pipeline padding machine, showing the manner in which this discharges fill material into the trench from the transversely extending conveyor assembly.
Figure 2:
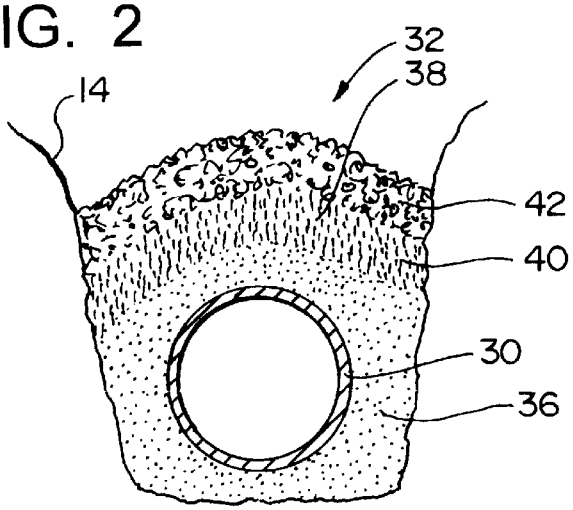
FIG. 2 is a cross-sectional view of a pipeline installed in an excavated trench, this having an exemplary multi-layer padding fill installed around and over the pipe.

As was noted above, the apparatus 50 also includes a system for adding a cement slurry component to the padding fill. As can be seen in FIG. 2, a silo 142 is included for holding a supply of cement dust; a suitable capacity for silo 142 is approximately 10,000 lbs. of cement dust. The dust is supplied to the assembly from an adjacent source, such as a truck or trailer (not shown), through a feed line 144 as indicated by arrow 146 in FIG. 3. The cement feed line discharges into a bag house 148 for dust control, and is fed therefrom to the top of silo 142 through a supply line 148.

A feed auger draws cement dust from the silo and discharges this through a line 150 which is mounted to the lower end of the silo, the other end 152 of the line being positioned to discharge the dust into the open upper end of the pivot hopper 182. A close tolerance, 61" diameter feed auger is suitable for the embodiment of apparatus which is shown in FIGS. 3–4.

The water component of the slurry, in turn, is provided from an adjacent source through water supply line 154, in the direction indicated by arrow 156 in FIG. 4. The end 158 of the water supply line also discharges into the open upper end of the pivot hopper 102, so that the water and cement dust combine with the flow of screened backfill material passing therethrough.

The screened fill, cement dust, and water pass vertically from hopper 102 through chute 104 and into the intake end of the auger trough 106. The rotation of the auger 112 thoroughly mixes the constituents and also moves them longitudinally through the trough, in the manner described above. Consequently, the cementitious slurry which forms the fill is thoroughly mixed by the time it is discharged through opening 118 into the trench.

Selective control of the water supply is provided by a valve mechanism (not shown), which is preferably operable from within the operator station 58; similarly, the rate of the cement dust feed can be controlled by means of a variable speed drive for the feed auger or other suitable mechanism, again preferably controlled from within the operator station. The water and cement supplies can be operated independently, so that water alone can be added in those instances where a flowable slurry is desired but a cementitious mix is not required.

The mixing can thus be performed in a consistent, efficient, and controllable manner on a continuous or periodic basis, as desired. Cementitious material may be added to replenish the silo as necessary, without affecting the mix ratio. This enables the machine to batch or produce continuously. For example, in an apparatus having the exemplary dimensions described above, mixing and batching can be controllably adjusted over a range from about 0–3 cubic yards per minute, with any desired slump. Moreover, if the filling operation must be interrupted for some reason, only the small amount of CLSM material which has already been mixed in the trough need be disposed of, rather than having to waste an entire truckload of ready-mix material as in the past.

It is to be recognized that various alterations, modifications, and/or additions may be introduced into the constructions and arrangements of parts described above without departing from the spirit or ambit of the present invention.

What is claimed is:

1. An apparatus for depositing fill material over a pipeline, said apparatus comprising:

a carriage for straddling a trench in which a pipeline has been placed;

a hopper mounted to said carriage for receiving a fill material;

a conveyor for conveying said fill material from said hopper to a discharge end which is positioned over said pipeline in said trench, said conveyor being mounted for pivoting movement relative to said carriage; and means for controllably pivoting said discharge end of said conveyor to selected discharge locations over said pipeline in said trench;

wherein said means for controllably pivoting said discharge end of said conveyor comprises;

a selectively extensible and pivotable boom having a first end mounted to said carriage and a second end mounted to said conveyor.

2. The apparatus of claim 1, wherein said conveyor extends forwardly from said carriage at an angle which is at least partially in-line with said pipeline in said trench.

3. The apparatus of claim 1, wherein said hopper mounted to said carriage comprises:

a shaker screen mechanism for separating and discarding oversize objects from said fill material.

4. The apparatus of claim 3, wherein said shaker screen mechanism comprises:

a two-deck shaker screen mechanism having upper and lower screens for separating said oversize objects from said fill material.

5. The apparatus of claim 3, further comprising:

a feed conveyor for conveying said fill material from said shaker screen mechanism to said pivotally mounted conveyor.

6. The apparatus of claim 2, wherein said carriage comprises:

first and second tracks for being positioned on opposite sides of said trench so as to propel said apparatus longitudinally along said trench.

7. The apparatus of claim 6, further comprising:

an operator station mounted on said carriage so as to be positioned above said trench which is straddled by said carriage, so as to afford an operator therein a downward, direct-line view of said pipeline in said trench.

8. The apparatus of claim 1, further comprising:

means for mixing a cement slurry with said fill material so as to form a CLSM fill material which is deposited on said pipeline in said trench.

9. The apparatus of claim 8, wherein said means for mixing a cement slurry with said fill material comprises:

a mixing auger mounted to said discharge end of said conveyor; and means for adding said cement slurry to said fill material in said auger.

10. The apparatus of claim 9, wherein said means for mixing a cement slurry with said fill material further comprises:

an auger trough for holding said fill material and cement slurry in contact with said auger during mixing.

11. The apparatus of claim 10, wherein said means for mixing a cement slurry with said fill material further comprises:

a mixing hopper mounted to said discharge end of said conveyor for receiving said fill material therefrom;

means for supplying said cement slurry to said mixing hopper; and means for discharging said fill material and cement slurry from said mixing hopper into said auger trough.

12. The apparatus of claim 11, wherein said means for supplying said cement slurry to said mixing hopper comprises:

a cement silo mounted to said carriage for holding a supply of cement dust;

a cement dust feed line having an intake end mounted to said silo and a discharge end for discharging said cement dust into an upper end of said mixing hopper; and a water feed line having an intake end mounted to a supply of water and a discharge end for discharging said water into said upper end of said mixing hopper.

13. The apparatus of claim 12, wherein said upper end of said mixing hopper is fixedly mounted to said discharge end of said conveyor, and a lower end of said mixing hopper is pivotally mounted to an intake end of said mixing trough so as so permit said mixing trough to pivot in a horizontal plane relative to said conveyor.

14. The apparatus of claim 13, wherein said means for controllably pivoting said discharge end of said conveyor comprises:

a selectively extensible and pivotable boom having a first end mounted to said carriage and a second end mounted to a discharge end of said auger trough.

15. The apparatus of claim 14, wherein said discharge end of said auger trough comprises:

a discharge opening on a lower side of said trough for discharging said CLSM fill material in a generally vertical downward direction onto said pipeline in said trench.

16. An apparatus for mixing and depositing a CLSM fill material over a pipeline, said apparatus comprising:

a mobile carriage;

a hopper mounted to said carriage for receiving a fill material;

means for mixing a cement slurry with said fill material so as to form a CLSM fill material; and means for depositing said CLSM material on said pipeline in said trench.

17. The apparatus of claim 16, wherein said hopper mounted to said carriage comprises:

a shaker screen mechanism for separating and discarding oversize objects from said fill material.

18. The apparatus of claim 17, wherein said means for mixing a cement slurry with said fill material comprises:

a mixing auger for receiving said fill material from said shaker screen mechanism; and means for adding said cement slurry to said fill material in said auger.

19. The apparatus of claim 18, further comprising:

a conveyor for conveying said fill material from said hopper to a receiving end of said mixing auger.

20. The apparatus of claim 19, wherein said means for mixing a cement slurry with said fill material further comprises:

an auger trough for holding said fill material and cement slurry in contact with said auger during mixing, said auger trough having a first end which is mounted to a discharge end of said conveyor and a second end for discharging said CLSM material onto said pipeline in said trench.

21. The apparatus of claim 20, wherein said conveyor has a first end which is mounted for pivoting movement relative to said carriage, and a second end which is mounted for pivoting movement relative to said auger trough.

22. The apparatus of claim 21, further comprising:

means for controllably pivoting said second end of said auger trough to selected discharge locations over said pipeline in said trench.

23. The apparatus of claim 22 wherein said means for controllably pivoting said second end of said auger trough comprises:

a selectively extensible and pivotable boom having a first end mounted to said carriage and a second end mounted to said auger trough.

24. The apparatus of claim 20, wherein said means for adding said cement slurry to said fill material in said auger comprises:

a mixing hopper mounted to said discharge end of said conveyor for receiving said fill material therefrom;

means for supplying said cement slurry to said mixing hopper; and means for discharging said fill material and cement slurry from said mixing hopper into said first end of said auger trough.

25. The apparatus of claim 24, wherein said means for supplying said cement slurry to said mixing hopper comprises:

a cement silo mounted to said carriage for holding a supply of cement dust;

a cement dust feed line having an intake end mounted to said silo and a discharge end for discharging said cement dust into an upper end of said mixing hopper; and a water feed line having an intake end mounted to a supply of water and a discharge end for discharging said water into said upper end of said mixing hopper.

26. An apparatus for depositing fill material over a pipeline, said apparatus comprising:

a carriage for straddling a trench in which a pipeline has been placed, said carriage comprising first and second tracks for being positioned on opposite sides of said trench so as to propel said apparatus longitudinally along said trench;

an operator station mounted on said carriage so as to be positioned above said trench which is straddled by said carriage, so as to afford an operator therein a downward, direct-line view of said pipeline in said trench;

a hopper mounted to said carriage for receiving a fill material, said hopper comprising a shaker screen mechanism for separating and discarding oversize objects from said fill material;

a conveyor for conveying said fill material from said hopper, said conveyor being mounted for pivoting movement relative to said carriage;

a mixing auger for receiving said fill material from said conveyor, said mixing auger being mounted in an auger trough for holding said fill material in contact with said auger during mixing, said auger trough having a first end which is mounted to a discharge end of said conveyor and a second end for discharging said fill material onto said pipeline in said trench;

means for adding a cement slurry to said fill material in said auger trough so that said fill material and cement slurry are mixed by said auger to form a CLSM material; and a selectively extensible and pivotable boom having a first end mounted to said carriage and a second end mounted to said auger trough for controllably pivoting said second end of said auger trough to selected discharge locations over said pipeline in said trench.

* * * * *